US006129655A

United States Patent [19]

Yamamoto et al.

[11] Patent Number: 6,129,655

[45] Date of Patent: Oct. 10, 2000

[54] METHOD OF FOLDING AND SHAPING SHEET, AND APPARATUS FOR FOLDING AND SHAPING SHEET

[75] Inventors: Masahiro Yamamoto, Osaka; Yoshimasa Yokoyama, Kohbe, both of Japan

[73] Assignees: Hitachi Zosen Corporation; Yokoyama Sankoh Co., Ltd., both of Japan

[21] Appl. No.: 09/180,543

[22] PCT Filed: May 8, 1997

[86] PCT No.: PCT/JP97/01552

§ 371 Date: Jan. 21, 1999

§ 102(e) Date: Jan. 21, 1999

[87] PCT Pub. No.: WO97/43200

PCT Pub. Date: Nov. 20, 1997

[30] Foreign Application Priority Data

May 16, 1996 [JP] Japan ..... 8-121492

[51] Int. Cl.[7] ..... B31F 1/00

[52] U.S. Cl. ..... 493/448; 493/411

[58] Field of Search ..... 493/448, 447, 493/446, 455, 411, 410, 409, 412, 430, 432, 433, 940, 941, 966; 156/474, 197

[56] References Cited

U.S. PATENT DOCUMENTS

| | | | |
|---|---|---|---|
| 3,434,400 | 3/1969 | Hochfeld | 493/447 |
| 4,425,111 | 1/1984 | Chazelas | 493/448 |
| 5,709,771 | 1/1998 | Fritzman | 493/410 |

*Primary Examiner*—John Sipos
*Assistant Examiner*—Steven Jensen
*Attorney, Agent, or Firm*—Lorusso & Loud

[57] ABSTRACT

A method by which a sheet, formed with peak and valley folds which are parallel and alternate, can be rapidly and smoothly folded and shaped, and an apparatus therefor. The method includes supplying a sheet in a naturally relaxed state onto a support guide, and applying a light pressing pressure on the sheet in a direction by which the angles between the folds are increased by means of a pressing guide. The pressing guide moves toward a support surface of the support guide when a pair of bending tools begin to apply a bending pressure to the sheet to correctly and smoothly fold and shape the sheet along the respective folds.

17 Claims, 12 Drawing Sheets

METHOD OF FOLDING AND SHAPING SHEET, AND APPARATUS FOR FOLDING AND SHAPING SHEET

TECHNICAL BACKGROUND

This invention relates to, in general, a method of folding and shaping a sheet and an apparatus for folding and shaping a sheet.

More specifically, it relates to a method of manufacturing a block body by folding and shaping a sheet formed with a single or a plurality of ridge-like fold(s) to which directional permanency of inward folding is imparted and a single or a plurality of valley-like fold(s) to which directional permanency of outward folding is imparted in parallel and alternately, and an apparatus therefor.

RELATED ART

It has been proposed to manufacture a block body by forming ridge-like folds to which directional permanency of inward folding (folding habit) is imparted and valley-like folds to which directional permanency of outward folding is imparted in parallel and alternately on a sheet having a hardness of some extent and capable of being folded easily such as a pasteboard or a corrugated cardboard and folding the sheet in zigzag fashion along the above-mentioned folds (Japanese Patent Application Nos. 6-103602, It has been also proposed to manufacture a hollow block body by forming a plurality of ridge-like folds and a plurality of valley-like folds on a sheet as mentioned above in parallel and alternately and folding the sheet along the folds (Japanese Patent Application No. 7-237405).

In the above-mentioned prior applications, it is proposed that the above-mentioned block bodies be used for a frame body or cushioning member for packaging, a core member of an adiabatic panel, a supporting material for various kinds of adsorbent or the like.

In addition, it is proposed that the sheet is preferably pressed in the direction of folding along the respective folds in order to fold the sheet, formed with the folds as mentioned above, into a zigzag shape or into a block body.

It is, however, a problem that the sheet can not be folded and shaped smoothly and quickly when the sheet formed with the folds as mentioned above is placed on a planar surface and the folding pressure is applied to the sheet in the direction of folding along the respective folds by a suitable pressing means, because the part of the sheet is raised from the surface or bounds upward due to resilience of the folds of the sheet.

SUMMARY OF THE INVENTION

An object of the present invention is to provide a method of folding and shaping a sheet, which enables manufacture of a block body by quickly and smoothly folding the sheet, formed with a single or plural ridge-like fold(s) to which directional permanency of inward folding is imparted, and a single or plural valley-like fold(s) to which directional permanency of outward folding is imparted, in parallel and alternately.

Another object of the present invention is to provide an apparatus for folding and shaping a sheet, with which the method capable of solving the above-mentioned problem is performed more efficiently.

A method of folding and shaping a sheet according to a first embodiment of the present invention comprises a first step of supplying a sheet 1 formed with many ridge-like folds 10 and valley-like folds 11, in a spontaneously developed state, to a predetermined working position d and a second step of applying a folding pressure on the sheet 1 in the direction of bending along the respective ridge-like folds 10 and the valley-like folds 11 and imparting a pushing pressure on the sheet 1 lightly tending to widen the folding angles of the ridge-like folds and the valley-like folds from the beginning or in the course of applying the folding pressure.

In the spontaneously developed (spread) state, the respective ridge-like folds 10 and valley-like folds 11 of the sheet 1 are bent inward or outward at an obtuse angle in the direction of the folding habit, since ridge-like folds 10 and valley-like folds 11 of the above-mentioned sheet 1 have resilience of some extent, and the whole of the sheet is gently corrugated.

According to the method of folding and shaping a sheet of the first embodiment, in the process of applying the folding pressure to the sheet 1 in the direction of folding along the ridge-like folds 10 and the valley-like folds 11 to which directional permanency of folding is imparted, addition of the light pushing pressure to the sheet in the direction of widening the folding angles of the ridge-like folds 10 and the valley-like folds 11 prevents part of the sheet 1 from rising from the working position.

Therefore, the sheet 1 can be folded and shaped along the respective ridge-like folds 10 and the valley-like folds 11 accurately, quickly and smoothly.

A method of folding and shaping a sheet according to a second embodiment of the present invention is a modification of the method of folding and shaping a sheet of the first embodiment wherein the sheet 1 is supplied onto a support guide 3 and then the pushing pressure is applied to the sheet 1 by a pressing guide 6 which moves away from the sheet 1 from a position close to the supporting surface of the support guide 3 with the sheet 1 sandwiched between itself and the support guide 3 while the sheet 1 is being folded and the folding pressure is applied to the sheet 1 by a pair of working tools 5*a*, 5*b* at least one of which moves toward and away from the other. According to the method of folding and shaping a sheet of the second embodiment, since the pushing pressure on the sheet 1 is decreased gradually as folding of the sheet proceeds, the sheet 1 can be folded and shaped more smoothly and quickly. In addition, since the folding pressure is applied to the sheet 1 by a pair of working tools 5*a*, 5*b* one of which moves toward or away from the other, the folding of the sheet 1 is performed more surely and no incomplete folding occurs.

A method of folding and shaping a sheet according to a third embodiment of the present invention is a modification of the second embodiment wherein paste portions 12 and non-paste portions 13 extending the direction orthogonal to the ridge-like folds 10 and the valley-like folds 11 are formed on opposite sides of the sheet 1 and wherein the support guide 3, the pressing guide 6 and the folding tools 5*a*, 5*b* make contact with the non-pasted portions 13 of the sheet 1. In the third mode, when paste is provided to the opposite sides of the sheet 1, since the support guide 3, the pressing guide 6 and the folding working tools 5*a*, 5*b* make contact with the non-pasted portions 13 of the sheet 1, the paste does not interfere with the support guide 3, the pressing guide 6 or the folding working tools 5*a*, 5*b* and folding and shaping of the sheet 1 can be performed more smoothly.

In order to attain the above-mentioned object, the present invention also provides an apparatus for folding and shaping a sheet which includes:

a support guide 3 for supporting a sheet formed with ridgelike folds and valley-like folds as described above, in a spontaneously developed (relaxed) configuration, a pressing guide 6 for moving toward and away from the supporting surface of the support guide 3 with the sheet 1 sandwiched between itself and the support guide 3, a pair of folding tools 5*a*, 5*b* disposed opposing each other across a predetermined distance for applying a folding pressure to the sheet 1 supported by the support guide 3 and along the ridge-like folds 10 and valley-like folds 11, and drive means 5 for reciprocably driving at least one of the is folding tools 5*a*, 5*b* toward and away from the other.

Thus, in the fourth embodiment, the present invention provides an apparatus for folding and shaping a sheet, according to the method of the first embodiment, surely and smoothly.

An apparatus for folding and shaping a sheet according to a fifth embodiment of the present invention is a modification of the fourth embodiment wherein the support guide 3 and the pressing guide 6 are each provided as a plurality of guides disposed with predetermined spacings and orthogonal to the ridge-like folds 10 and the valley-like folds 11 of the sheet 1 supplied to the working position d. One of the folding working tools 5*a*, 5*b* is a pusher and is installed at one end of at least one support guide 3, and the other of the folding working tools 5*a*, 5*b* is a stopper for stopping the motion of the sheet 1. A drive means 5 is disposed in association with the pusher 5*a* so as to reciprocably drive the pusher 5*a*. With the apparatus of the fifth embodiment, when a support guide 3, a pressing guide or a pusher 5*a* is damaged or broken, the apparatus can be repaired easily by exchanging only the damaged or broken member or component. Further, since the moving drive means 5 drives only the pusher 5*a*, the structure of the apparatus for folding and shaping a sheet according to the fifth embodiment is more simplified.

An apparatus for folding and shaping a sheet according to a sixth embodiment of the present invention is a modification of the fifth embodiment wherein the individual support guides 3 and the individual pressing guides 6 are disposed opposite each other. According to the apparatus for folding and shaping a sheet according to the sixth embodiment, since the individual support guides 3 and the individual pressing guides 6 are disposed opposite each other and the light pushing pressure and the folding pressure are evenly applied, and no immoderate force is applied to the sheet 1 and the sheet 1 can be folded more smoothly.

An apparatus for folding and shaping a sheet according to a seventh embodiment of the present invention comprises, in addition to the apparatus elements of the fifth embodiment, adjusting drive means 40–45 and 80–85 for moving respective support guides 3 and the respective pressing guides 6 independently in the direction of the ridge-like folds 10 and the valley-like folds 11 of the sheet 1. The apparatus for folding and shaping a sheet according to the seventh mode is capable of moving the respective support guides 3 and the respective pressing guides 6 independently in the direction of the ridge-like folds 10 and the valley-like folds 11 of the sheet 1. Therefore, the distances between the respective guides 3 and those between the respective pressing guides 6 can be adjusted according to the size of the sheet 1 or the positions of the pasted areas. Along with the adjustment of the distances between the respective guides 3 and those between the respective pressing guides 6, the positions of the pushers 5*a* can be also is adjusted.

An apparatus for folding and shaping a sheet according to the eighth embodiment of the present invention is a modification of the seventh embodiment wherein the adjusting drive means 80–85 for moving the respective pressing guides 6 consist of screw shafts 801, 811, 821, 831, 541 and 851, motors 810, 820, 830, 840 and 850 for driving the screw shafts 801, 811, 821, 831, 841 and 851 and screw guides 803, 813, 823, 833, 843 and 853 through which the screw shafts 801, 811, 821, 831, 841 and 851 extend respectively. Screw guides 803, 813, 823, 833, 843 and 853 are associated with the respective pressing guides 6 to move the pressing guides 6 in the direction perpendicular to the supporting surfaces of the support guides 3, and the pressing guides 6 are guided directly or indirectly by guide rails 2*f*, 2*g*, 2*h*, 2*i* disposed in a direction orthogonal to the pressing guides 6. With the apparatus for folding and shaping a sheet according to the eighth embodiment, since the adjusting drive means 80–85 respectively consist of screw shafts 801, 811, 821, 831, 841 and 851, motors 810, 820, 830, 840 and 850 for driving the screw shafts 801, 811, 821, 831, 841 and 851 and screw guides 803, 813, 823, 833, 843 and 853 through which the screw shafts 801, 811, 821, 831, 841 and 851 extend, adjustment of the positions of the respective pressing guides 6 can be conducted smoothly and even small adjustments can be made easily and surely. In addition, since the respective screw guides 803, 813, 823, 833, 843 and 853 are associated with the respective pressing guides 6 to move the pressing guides 6 in the direction perpendicular to the supporting surface of the support guide 3 and the pressing guides 6 are guided directly or indirectly by guide rails 2*f*, 2*g*, 2*h*, 2*i*, the pressing guides 6 can be moved smoothly while adjusting their positions.

An apparatus for folding and shaping a sheet according to a ninth embodiment of the present invention is a modification of the apparatus of the seventh embodiment wherein the adjusting drive means 40 to 45 for moving the respective support guides 3 consist of screw shafts 401, 411, 412, 431, 441 and 451 disposed orthogonal to the respective support guides 3, motors 400, 410, 420, 430, 440 and 450 for driving the screw guides 401, 411, 412, 431, 441 and 451, and screw guides 403, 413, 423, 433, 443 and 453 through which the respective screw shafts 401, 411, 412, 431, 441 and 451 extend. The screw guides 403, 413, 423, 433, 443 and 453 are connected to the respective support guides 3 and the support guides 3 are guided directly or indirectly by the guide rails 20 to 23 disposed in a direction orthogonal to the support guides 3. According to the apparatus of the ninth embodiment, adjustment of the positions of the respective support guides can be conducted smoothly and, even very small adjustments can be made easily and accurately. In addition, since the screw guides 403, 413, 423, 433, 443 and 453 are connected to the respective support guides 3 and the support guides 3 are guided directly or indirectly by the guide rails 20 to 23 disposed in a direction orthogonal to the support guides 3, the support guides 3 can be moved while the positions thereof are adjusted.

An apparatus for folding and shaping a sheet according to a tenth embodiment of the present invention is a modification of the fifth embodiment wherein an actuator Sc retracts the stopper 5*b* from a position suitable for suppressing the motion of the sheet 1 to another position and returns the same to the motion suppressing position. In this embodiment a block body 1*a* formed of the sheet 1 can be handled easily, without interference with the stopper 5*b*, by retracting the stopper 5*b* after the sheet 1 is folded and shaped.

An apparatus for folding and shaping a sheet according to an eleventh embodiment of the present invention is a modification of the fifth embodiment, wherein the moving drive means 5 consists of a pair of geared pulleys or sprockets 51, 52, a timing belt or chain belt 53 mounted on the pair of geared pulleys or sprockets 51, 52 and connected with the pusher 5*a*, a guide rail 54 disposed along the timing belt or chain belt 53 and a servo motor 50 for driving the geared pulleys or sprockets 51, 52, and wherein the pusher 5*a* is guided directly or indirectly by the guide rail 54. According to the eleventh embodiment, the motion of the pusher 5*a* can be controlled more smoothly.

An apparatus for folding and shaping a sheet according to the twelfth embodiment of the present invention is a modification of the fourth embodiment further including a movable frame 78 which moves along a guide 76 in the direction perpendicular to the support surface of the support guide 3, and a drive mechanism 7 for operating the movable frame 78 along the guide 76 using the servo motor 70 and wherein the pressing guides 6 are connected to the movable frame 78 to be moved toward and away from the support surfaces of the support guides 3. With the apparatus of the eleventh embodiment, the respective pressing guides 6 can be controlled more smoothly in movement toward and away from the support guide 3.

BRIEF DESCRIPTION OF DRAWINGS

FIG. 7(*a*) is a partial front view showing a sheet supplied onto the support guide, and FIG. 7(*b*) is the same showing the sheet folded and shaped.

FIG. 9(*a*) is a partial front view showing a sheet supplied onto the support guide, and FIG. 9(*b*) is the same showing the sheet folded and shaped.

FIG. 11(*a*) is a side view of the sheet in a spontaneously developed state, and FIG. 11(*b*) is a side view of a block body obtained by folding the sheet.

DETAILED DESCRIPTION OF PREFERRED EMBODIMENTS

The sheet folding and shaping apparatus according to preferred embodiments of the present invention will now be explained with reference to the accompanying drawings.

A first embodiment of the present invention is described below with reference to FIGS. 1–7(*b*).

A side portion (upper portion in FIG. 2) of a sheet folding and shaping apparatus of the present embodiment is provided with a pasting apparatus (not shown). A sheet 1, both sides of which paste is applied to, is supplied in the direction of an arrow c in FIG. 2 onto a support guide 3, which is a working position d of the sheet folding and shaping apparatus, in a spontaneously developed state (shape).

Figure 6:
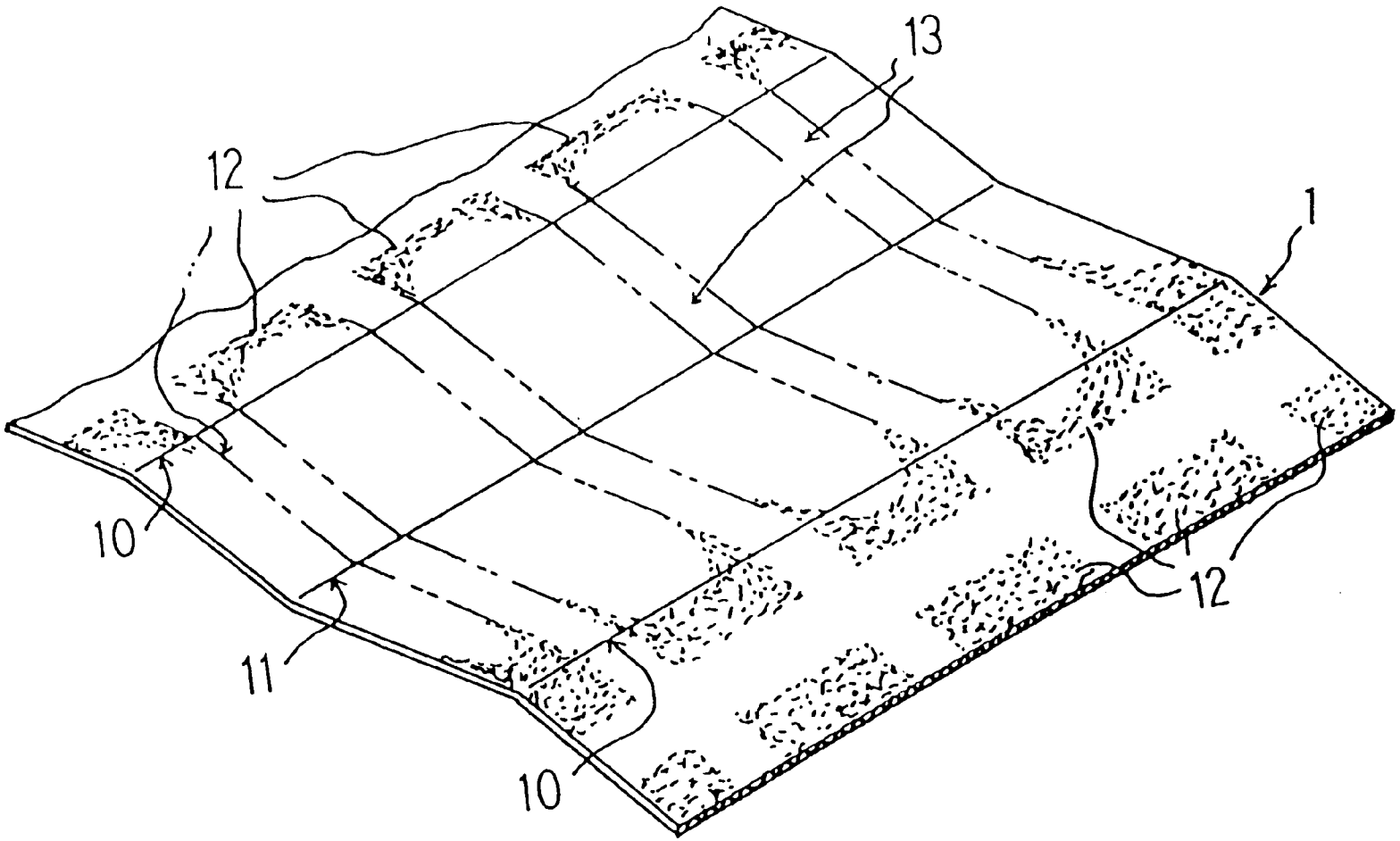
FIG. 6 is a schematic partial view of a sheet used in a method of folding and shaping a sheet according to the first embodiment.

The sheet 1, which is a workpiece to be processed by the folding and shaping apparatus, is a corrugated cardboard. As shown in FIG. 6, the sheet 1 is formed with folds (creases) 10 to which directional permanency of ridge-like folding is imparted and folds (creases) 11 to which directional permanency of valley-like folding is imparted alternately and in parallel. These ridge-like and valley-like folds 10, 11 intersect corrugations of the corrugated cardboard.

As shown in FIG. 6, paste is applied in a preliminary treatment so that both sides of the sheet 1 are formed with non-paste portions 13 at given intervals in a direction intersecting the ridge-like and valley-like folds 10, 11. The portions other than the non-paste portions 13 become paste portions 12. In the sheet 1 shown in FIG. 6, the paste portions 12 and non-paste portions 13 on opposing sides of sheet 1 are positioned back to back. However, they need not be positioned back to back.

Since the above-mentioned folds 10, 11 of the sheet 1 have elasticity to some extent, each of the folds 10, 11 spontaneously develops a slight bend in the direction imparted by directional permanency of folding, and therefore, the whole sheet 1 corrugates slightly.

Figure 1:
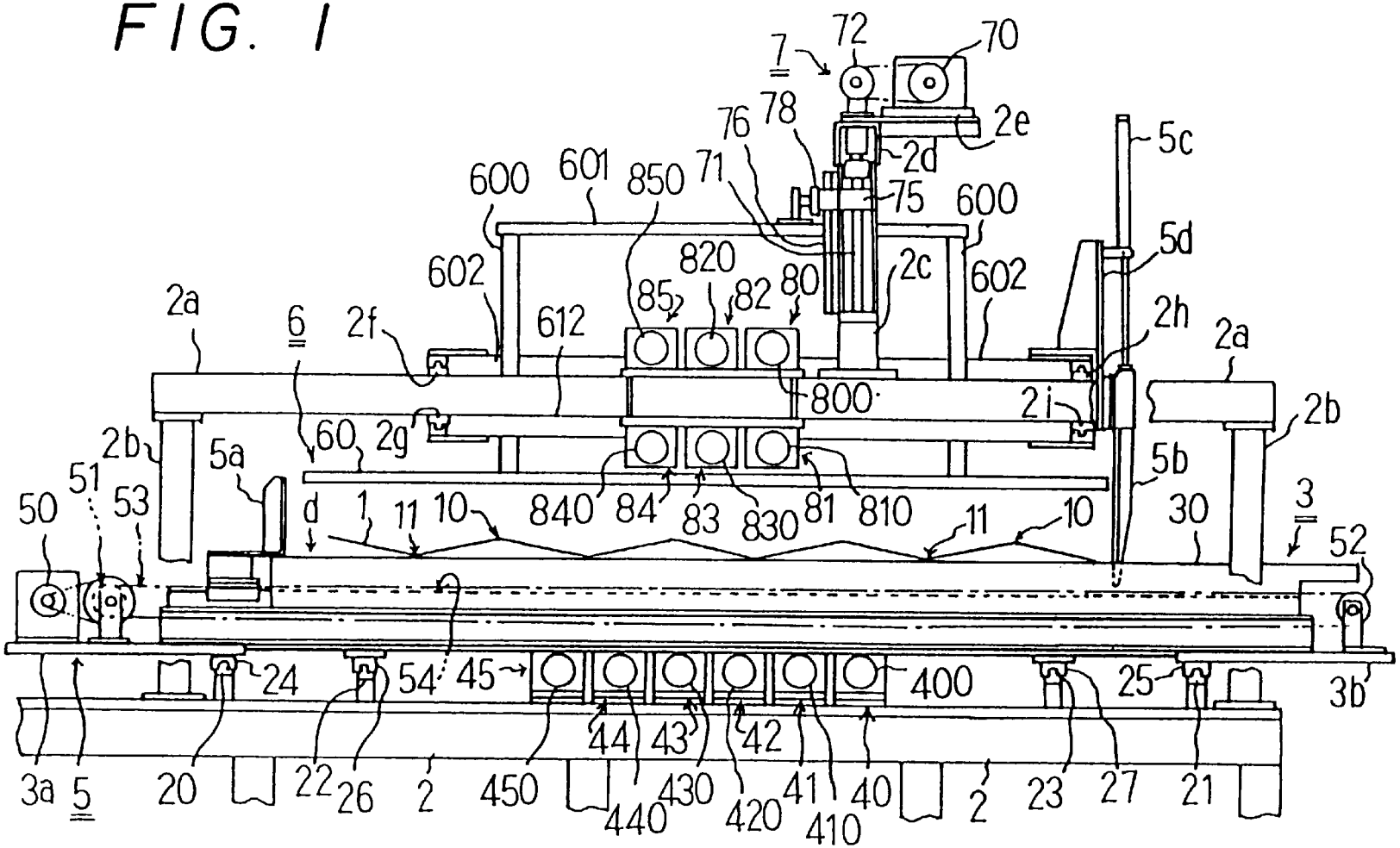
FIG. 1 is a schematic front view of a sheet folding and shaping apparatus according to one embodiment of the present invention.
Figure 2:
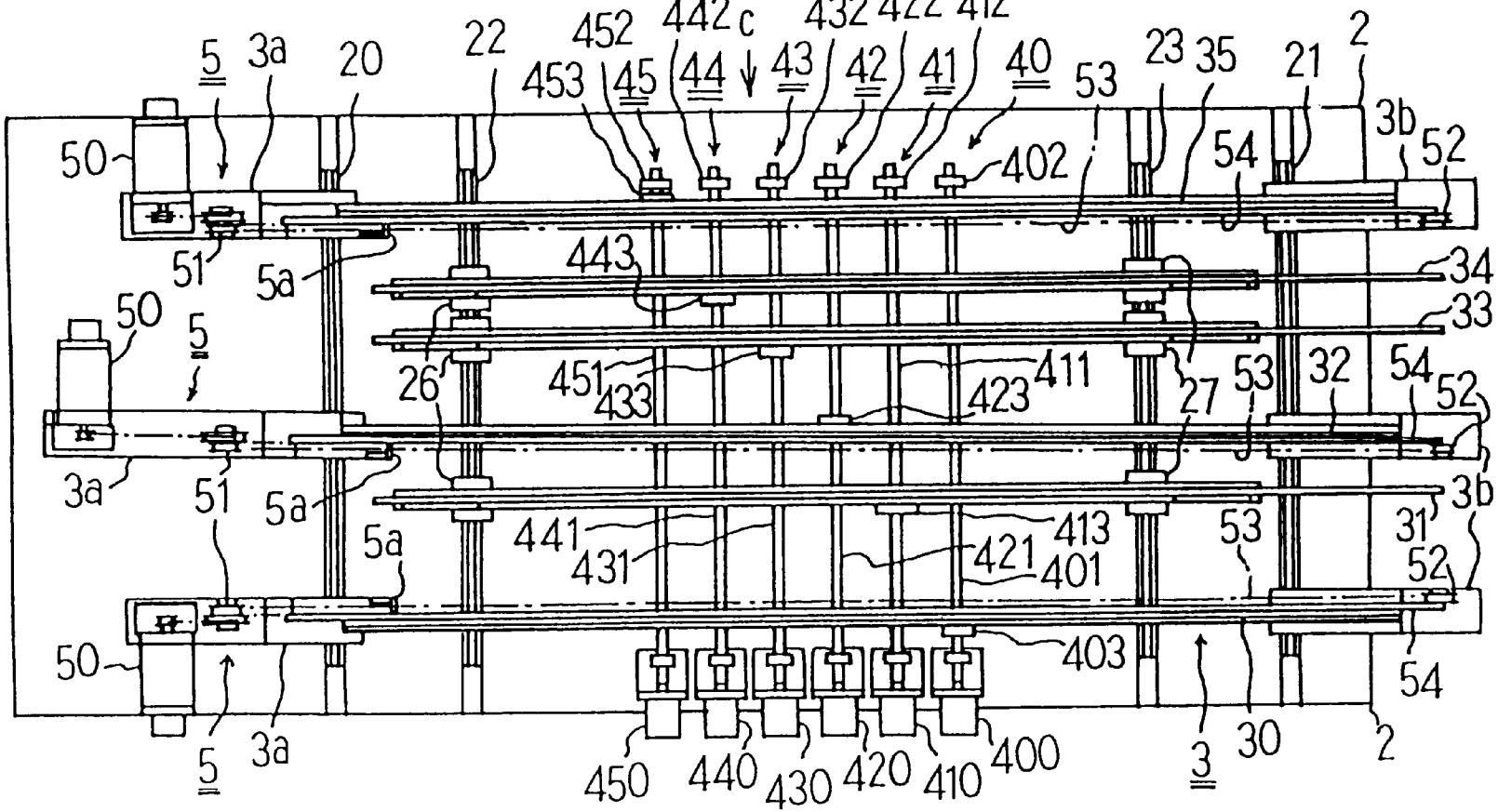
FIG. 2 is a schematic plan view of support guides and a drive system associated therewith in the apparatus shown in FIG. 1.

In this embodiment, as shown in FIGS. 1 and 2, the support guide 3 consists of 6 (six) rod-shaped support guides 30, 31, 32, 33, 34 and 35. These support guides 30 to 35 are positioned on a base 2 extending in a direction which intersects the folds 10, 11 of the supplied sheet 1.

Each of support guides 30 to 35 in this embodiment, as shown in FIGS. 1 and 2, is supported by two of guide rails 20, 21, 22 and 23, which are fixed on the base 2 in a state that they intersect support guides 30 to 35, and are movable by one of the respective adjusting drive means 40, 41, 42, 43, 44 and 45 along the guide rails 20 to 23.

In this embodiment, the support guides 30, 32 and 35 are supported by the guide rails 20 and 21 via linear bearings 24 and 25 (see FIG. 1), and the other support guides 31, 33 and 34 are supported by the guide rails 22 and 23 via linear bearings 26 and 27.

The adjusting drive means 40 to 45 consist of respective motors 400, 410, 420, 430, 440 and 450 fixed to one side of the base 2 and screw shafts 401, 411, 412, 413, 414 and 415, which are rotatably supported by the respective bearing members 402, 412, 422, 432, 442 and 452, which have tips fixed to the other side of the base 2, and are connected to the respective motors 400 to 450.

The screw shafts 401, 411, 421, 431, 441 and 451 penetrate through respective screw guides 403, 413, 423, 433, 443 and 453. The screw guides 403, 413, 423, 433, 443 and 453 are connected to the support guides 30, 31, 32, 33, 34 and 35, respectively.

Accordingly, each of the motors 400 to 450 operate so as to make the respective one of the support guides 30 to 35 move along the guide rails 20 and 21 or guide rails 22 and 23, whereby the distances between and positions of support guides 30 to 35 can be adjusted.

In this embodiment, although servo motors are used as the above-mentioned motors 400, 410, 420, 430, 440 and 450, stepping motors or the like may be used.

As shown in FIG. 2, the support guides 30, 32 and 35 are provided with pushers, which are folding tools 5*a*, at one side thereof. Each of the pushers 5a is reciprocably driven by one of the drive means 5 provided in association with the respective support guides 30, 32 and 35 such that it moves toward a stopper which is the other folding tool 5*b* to be described later and thereafter returns to the illustrated original position.

In this embodiment, the ends of the support guides 30, 32 and 35 are respectively fixed to base plates 3*a* and 3*b*.

Each of drive means 5 includes a servo motor 50 mounted on a base plate 3*a*, a geared pulley (or a sprocket) 51 mounted on the base plate 3*a*, a geared pulley (or a sprocket) 52 mounted on the other base plate 3*b*, a timing belt (or a chain belt) 53 wound around the geared pulleys 51, 52 and connected to the pusher 5*a*, and a guide rail 54 positioned over the base plates 3*a* and 3*b* along the timing belt 53. The pusher 5*a* is guided by the guide rail 54 via a linear bearing (not shown).

Accordingly, clockwise or counterclockwise rotation of each of the servo motors 50 makes one of the respective pushers 5*a* travel along the guide rail 54 a predetermined distance.

A pressing guide 6 (FIGS. 1 and 3) is located above the support guide 3.

Figure 3:
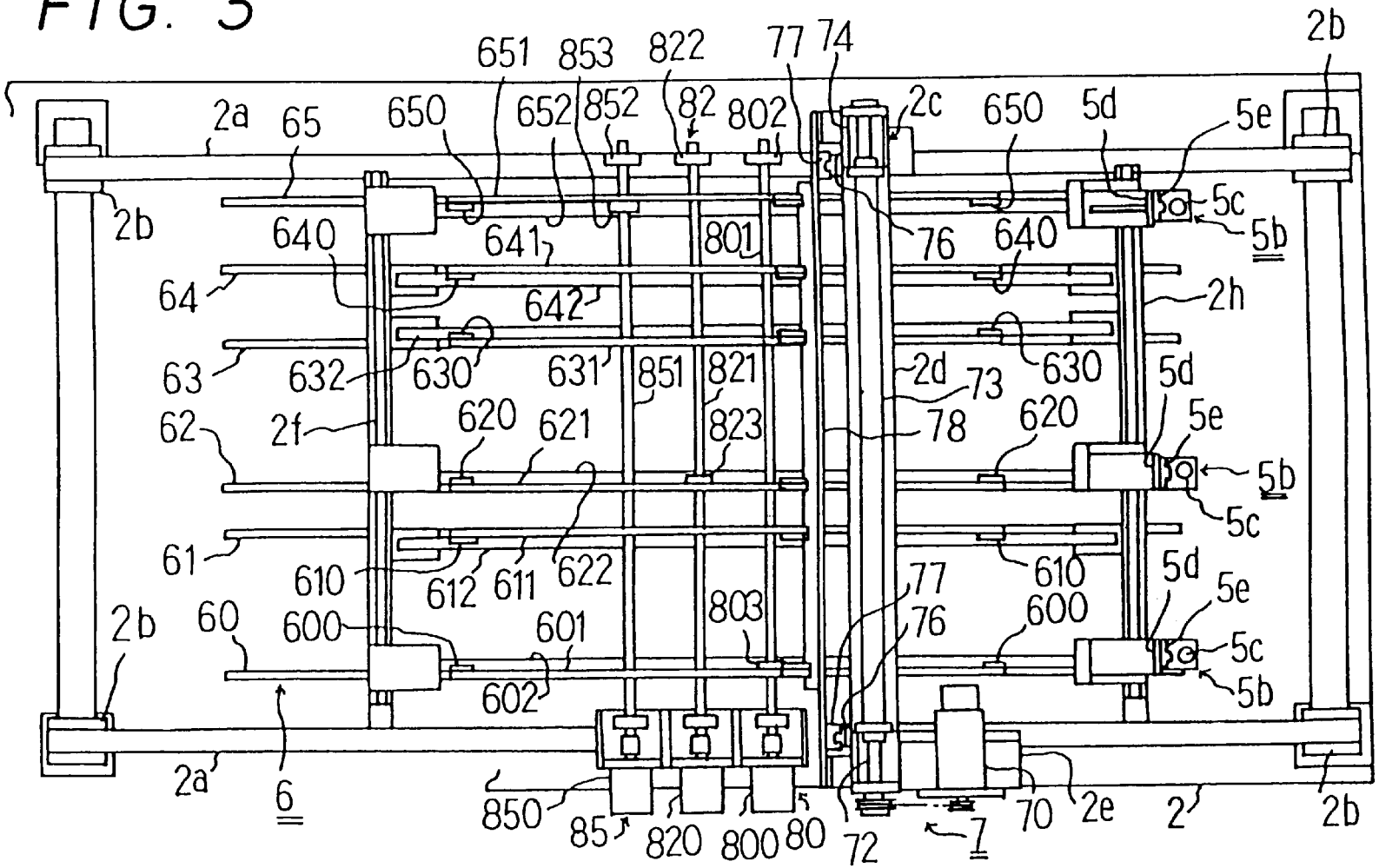
FIG. 3 is a schematic plan view of pressing guides and a drive system associated therewith in the apparatus shown in FIG. 1.

As shown in FIG. 3, the pressing guide 6 includes rod-shaped pressing guides 60, 61, 62, 63, 64 and 65 facing the respective support guides 30, 31, 32, 33, 34 and 35.

As shown in FIGS. 1 and 3 to 5, at the 4 (four) corners of the base 2, columns 2*b* stand vertically, and frame members 2*a*, 2*a* are fixed to the respective columns 2*b* like bridges. A pair of columns 2*c*, 2*c* stand vertically on the frame members 2*a*, 2*a*. The columns 2*c*, 2*c* are connected via a bridge-like frame member 2*d* at their upper ends.

The columns 2*c*, 2*c* are provided with a drive mechanism 7 for raising and lowering the pressing guides 60 to 65, toward and away from the support guides 30 to 35.

Figure 5:
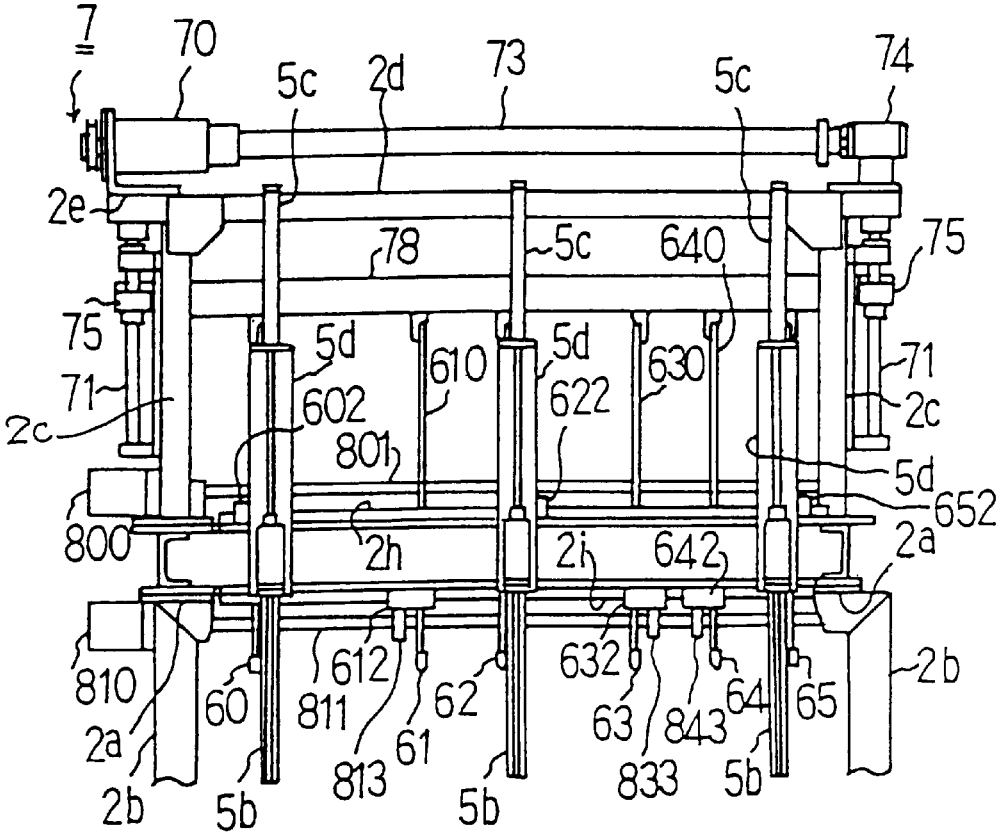
FIG. 5 is a partial right side view of the apparatus in FIG. 1.

As seen in FIGS. 1, 3 and 5, drive mechanism 7 is provided with a servo motor 70 mounted on the upper portion of one of the columns 2*c* via a bracket 2*e*. Screw shafts 71, 71 are rotatably supported by and extend vertically along the respective columns 2*c*, 2*c*. A speed reducer 72 reduces the rotation speed of the servo motor 70 and transfers the reduced rotation to one of the screw shafts 71 and, via a transfer shaft 73 and rotation transform means 74, to the other screw shaft 71. The drive mechanism further includes screw guides 75, 75 through which the respective screw shafts 71, 71 extend, rail-like guides 76, 76 positioned vertically along the respective columns 2*c*, 2*c*, and a movable frame member 78 linked to the guides 76, 76 via linear bearings 77, 77 and connected to the screw guides 75, 75.

Figure 4:
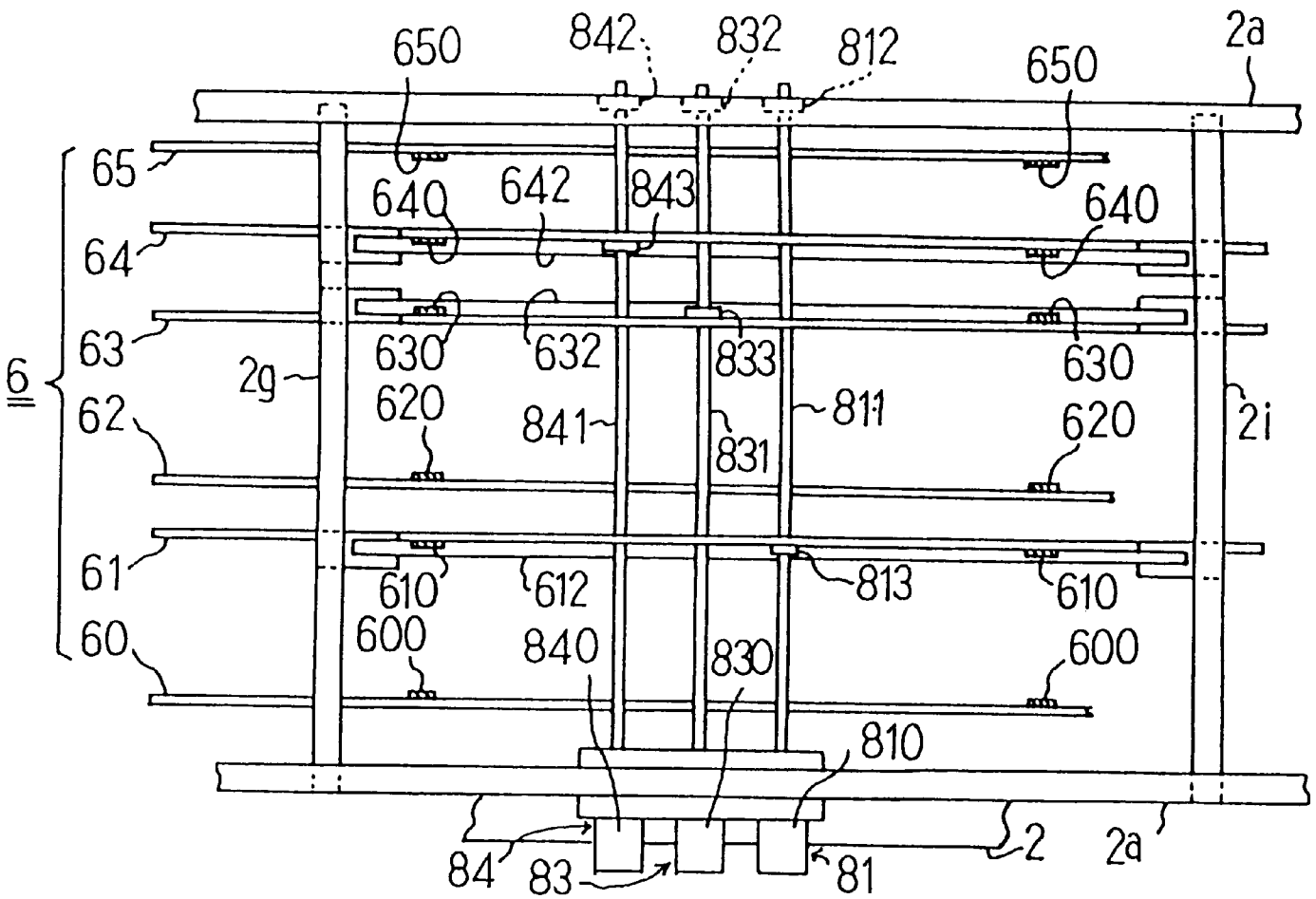
FIG. 4 is a schematic plan view of lower pressing guides and a drive system associated therewith.

As shown in FIG. 4, pairs of vertical bars 600, 610, 620, 630, 640 and 650 are connected, at their lower ends, to the respective pressing guides 60 to 65. Further, as shown in FIG. 3, the vertical bars 600, 610, 620, 630, 640 and 650 of the pair are connected with each other, at the upper end thereof, by horizontal bars 601, 611, 621, 631, 641 and 651 respectively. The horizontal bars 601 to 651 are connected to the movable frame member 78.

Accordingly, when the screw shafts 71, 71 are rotated as the servo motor 70 rotates, the screw guides 75, 75 rise and fall accompanied with the pressing guides 60 to 65 and the movable frame member 78.

Each of the pressing guides 60 to 65 according to this embodiment is guided by one pair of guide rails 2*f*, 2*h* or 2*g*, 2I and moved along the guide rails 2*f* to 2I by one of the respective adjusting drive means 80, 81, 82, 83, 84 and 85.

In this embodiment, rod-shaped movable bases 602, 612, 622, 632, 642 and 652 are paired with corresponding pressing guides 60, 61, 62, 63, 64 and 65. The movable bases 602, 622 and 652 are guided by the upper guide rails 2*f* and 2*h* shown in FIGS. 1 and 3 via linear bearings (not shown). On the other hand, the movable bases 612, 632 and 642 are guided by the lower guide rails 2*g* and 2*i* shown in FIGS. 1 and 4 via linear bearings (not shown).

The adjusting drive means 80 to 85 include motors 800, 810, 820, 830, 840 and 850 fixed to one of the frames 2*a* and screw shafts 801, 311, 821, 831, 841 and 851 rotatably supported by the bearing members 802, 812, 822, 832, 842 and 852, which are connected, at their ends, to the other of the frame members 2*a*, and connected to the motors 800 to 850, respectively.

The screw shafts 801, 811, 821, 831, 841 and 851 extend through the respective screw guides 803, 813, 823, 833, 843 and 853. The screw guides 803, 813, 823, 833, 843 and 853 are connected to the movable bases 602, 612, 622, 632, 642 and 652, respectively.

The vertical bars 600, 610, 620, 630, 640 and 650, shown in FIGS. 3 and 4, connected to the respective pressing guides 60 to 65, also connect with the respective movable bases 602, 612, 622, 632, 642 and 652 50 as to enable them to move in a vertical direction.

Accordingly, the respective pressing guides 60 to 65 are moved along the pair of guide rails 2*f*, 2*h* or 2*g*, 2*i* by operation of the motors 800 to 850 and, thereby, the distances therebetween or positions thereof are adjusted as desired.

In this embodiment, although the servo motors are used as the motors 800, 810, 820, 830, 840 and 850, stepping motors or the like may be used.

In the apparatus according to this embodiment, as shown in FIGS. 1 and 3, the stoppers, which are the other folding tools 5*b*, are mounted on respective movable bases 602, 622 and 652 via the brackets Sd so as to be horizontally movable together with the respective pressing guides 60, 62 and 65, and may be raised and lowered to a predetermined extent along the guides 5*e* using the respective actuators 5*c* which, in this embodiment, are air cylinders.

First Working Example of Sheet Folding and Shaping

A working example of the sheet folding and shaping method will now be explained as well as the operation of the folding and shaping apparatus according to the above-described embodiment.

Before the apparatus starts working, each of the motors 400 to 450 and 800 to 850 is operated so as to adjust the distances between the adjacent support guides 30 to 35 and pressing guides 60 to 65 according to the design of the folds 10, 11, paste portions 12 and non-paste portions 13 of sheet 1 shown in FIG. 6. In adjusting these distances, the pushers 5*a*, moving drive means 5 and stoppers 5*b* are moved.

At this moment, if the number of stripes of the non-paste portions in sheet 1 is small, or if the width of sheet 1 (i.e., the dimension in the direction of folds 10, 119) is narrow, and therefore, some of the support guides 30 to 35 and the pressing guides 60 to 65 are unnecessary, the unnecessary ones in the support and pressing guides 30 to 35 and 60 to 65 are moved upward in the apparatus shown in FIGS. 2 and 3.

The sheet 1 is supplied to the working position d in such an orientation that each of the folds 10, 11 is perpendicular to the support guides 30 to 35 and the pressing guides 60 to 65.

When the sheet 1 is supplied to working position d, namely, onto the support guides 3, the support guides 3 come into contact with the non-pasted portions 13 of sheet 1 and the pressing guides 6 are positioned just above the non-pasted portions 13.

Figure 7A:
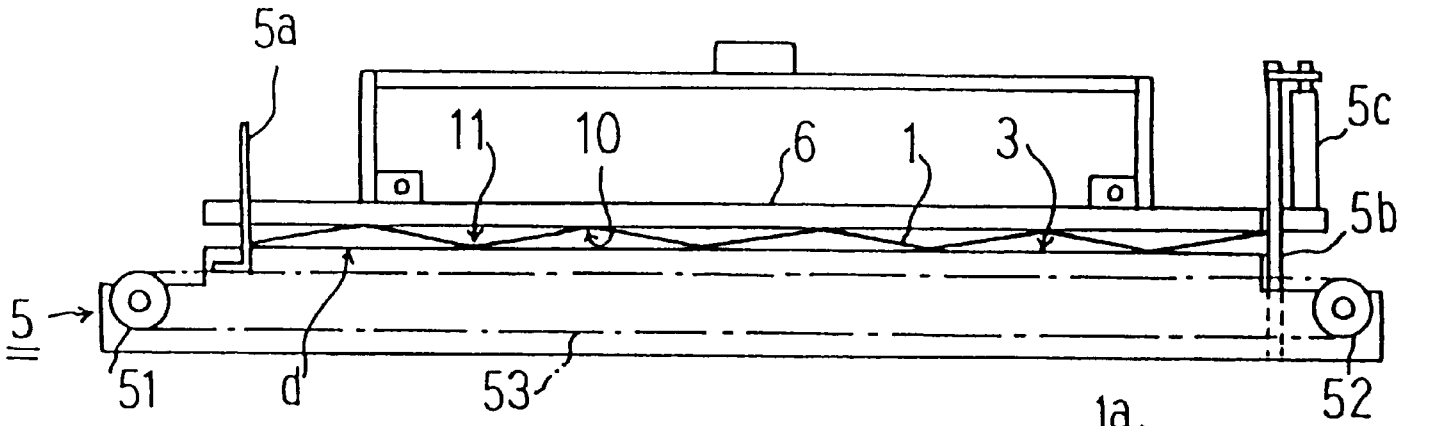
FIGS. 7(*a*) and 7(*b*) are schematic front views of the apparatus for explanation of the method for folding and shaping a sheet in accordance with the first embodiment of the present invention.
Figure 7B:
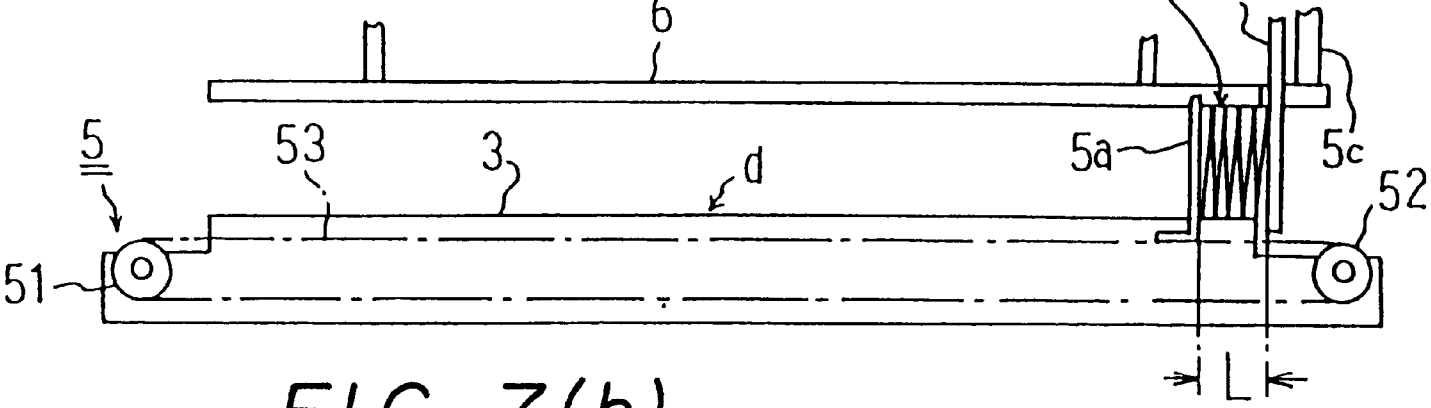

After the sheet 1 is supplied onto the support guide 3, the actuators 5*c* lower the stoppers 5*d*, while the servo motor 70 lowers the pressing guides 6 as shown in FIG. 7(*a*) so as to apply a light pressing pressure to the spontaneously shaped (relaxed) sheet 1 in a direction by which the folding angles of the folds 10, 11 are widened.

The servo motor 50 shown in FIG. 2 is then activated to move the pusher 5*a* toward the stopper 5*b*. Since the sheet 1 is gradually folded in a way that the angles of the folds 10, 11 are narrowed by means of the movement of pusher 5*a*, the servo motor 70 is rotated in a reverse direction to gradually raise the pressing guides 6 synchronously with the folding of sheet 1.

When the sheet 1 is folded as shown in FIG. 7(*b*), an encoder (not shown) provided within the servo motor 50 detects a working size L indicative of the size of folded sheet 1. In response to this detection, the servo motor 50 stops.

In the folded state shown in FIG. 7(*b*), the facing folded surfaces of the sheet 1 adhere to each other, thereby obtaining a block body 1*a* of a desired shape. The stopper 5*b* is raised by means of the actuator 5*c* while the pressing guide 6 is raised so as to convey the block body 1*a* to a subsequent process (e.g., drying process).

The thus described operation and control are repeated.

If neither of the surfaces of sheet 1 is adhesive, the sheet 1 is shrink-packaged in a folded state shown in FIG. 7(*b*) using a shrink film or is banded together using suitable means to maintain the block shape.

Suppose that the block body la is intended to be used as a frame body for packaging or cushioning member, or as a core of an insulation panel, and the folding of sheet 1 is one operation in the packaging line of the article or the manufacturing line of the panel, the sheet 1 is not pasted before the folding, and is packed in a box or pushed into a hollow panel in the folded state.

According to this working example of the sheet folding and shaping method, when a bending (folding) pressure is applied to the sheet 1 in the folding direction along the folds 10, 11, a light pressure is applied in a direction in which the angles of the folds 10, 11 are widened. Accordingly, it is possible to prevent portions of the sheet 1 from rising upward from the working position d or bounding in a direction towards the ridge-like folds 10.

Therefore, it is possible to fold and shape the sheet 1 along each of the folds 10, 11 accurately, quickly and smoothly.

According to this working example of sheet folding and shaping method, a bending pressure to the sheet 1 is supplied by the pressing guide 6 which operates between a position where it is in the vicinity of the support surface of support guide 3 with the sheet 1 in between and a position wherein it is away from the sheet 1 as the sheet 1 is folded. Accordingly, the bending pressure to the sheet 1 is gradually decreased as the sheet 1 is folded, thereby enabling the sheet 1 to be shaped into the folded state more smoothly and quickly.

In addition, since the bending pressure is certainly applied to the sheet 1 by the pair of bending working tools 5*a*, 5*b*, one of which move toward and away from the other, the sheet 1 can be fold surely without folding failure.

According to this working example of sheet folding and shaping method, in the case where both surfaces of sheet 1 are pasted, the support guide 3, pressing guides 6 and folding tools 5*a*, 5*b* are in contact with the non-pasted portions 13 of sheet 1. Accordingly, it is possible to accomplish the folding and shaping more smoothly without interference of the adhesive.

The support guide 3 and the pressing guide 6 respectively consist of a plurality of guides positioned at given intervals so as to intersect the folds 10, 11 of sheet 1 supplied onto the working position d and one of the folding tools 5*a*, 5*b* is the pusher 5*a*, which is provided at one end of the support guide 3. Accordingly, if the support guide 3, pressing guide 6 or pusher 5*a* is damaged, the apparatus can be repaired by merely exchanging the damaged elements or components.

Regarding the moving drive means 5, since only the pusher 5*a* is reciprocated, it is possible to simplify the structure of apparatus.

The support guides 30 to 35 face the respective bending guides 60 to 65 and the light pressing pressure and the bending pressure are evenly applied to the sheet 1, and therefore excess pressure is not applied to the sheet 1.

Accordingly, it is possible to fold and shape the sheet 1 more smoothly.

The support and pressing guides 30 to 35 and 60 to 65 can be individually moved along the folds 10, 11 of sheet 1 by means of the respective adjusting drive means 40 to 45 and 80 to 85. Accordingly, it is possible to adjust the distances between the adjacent guides constituting the support guide 3 and pressing guide 6 according to the design of the sheet, e.g., the size of sheet 1 and the positions of the adhesive.

Further, simultaneously with the adjustment of distances between the support guide 3 and pressing guide 6, the positions of pusher 5*a* and stopper 5*b* can be adjusted.

The adjusting drive means 80 to 85, which move the respective pressing guides 60 to 65, include the respective screw shafts 801, 811, 821, 831, 841 and 851, the respective motors 800, 810, 820, 830, 840 and 850 which drive the respective screw shafts 801, 811, 821, 831, 841 and 851, and the respective screw guides 803, 813, 823, 833, 843 and 853 through which the respective screw shafts 801, 811, 821, 831, 841 and 851 extend. Accordingly, the positions of pressing guides 60 to 65 can be adjusted more smoothly, even very small adjustments can be made easily and accurately.

Each of the respective screw guides 803, 813, 823, 833, 843 and 853 are linked to the respective pressing guides 60 to 65 in a direction perpendicular to the support surfaces of the support guides 30 to 35, and the respective pressing guides 60 to 65 are indirectly guided by the pair of guide rails 2*f*, 2*h* or 2*g*, 2*i*. Accordingly, the respective pressing guides 60 to 65 are moved smoothly when the positions thereof are adjusted.

The same advantages can be obtained for the adjusting drive means 40 to 45 associated with the support guides 30 to 35.

Since the sheet folding and shaping apparatus of the above-described embodiment is provided with the actuator 5*c* which retracts the stopper 5*b* from a position suitable, i.e., engaged position, for restricting the movement of sheet 1 to a disengaged position, and returns it to the engaged position, it is possible to easily handle the block body la after folding the sheet 1.

The drive means 5 of the pusher 5*a* includes the servo motor 50, the pair of geared pulleys or sprockets 51, 52, the timing belt or chain 53 wound around the pair or geared pulleys or sprockets 51, 52 and connected to the pusher 5*a*, and the guide rail 54 positioned along the timing belt or chain 53, and the pusher 5*a* is guided by the guide rail 54. Accordingly, it is possible to control the movement of pusher 5*a* more smoothly.

The sheet folding and shaping apparatus of the above-described embodiment includes the movable frame member 78 which can move perpendicular to the support surface of support guide 3 along the guides 76 and the drive mechanism 78 which operates the movable frame member 78 along the guides 76 using the servo motor 70, and the respective pressing guides 60 to 65 are linked to the movable frame member 78. Accordingly, it is possible to control the movement of the pressing guides 60 to 65 toward and away from the support guide 3 more smoothly.

Second Working example of the Sheet Folding and Sharing Method

Figure 8:
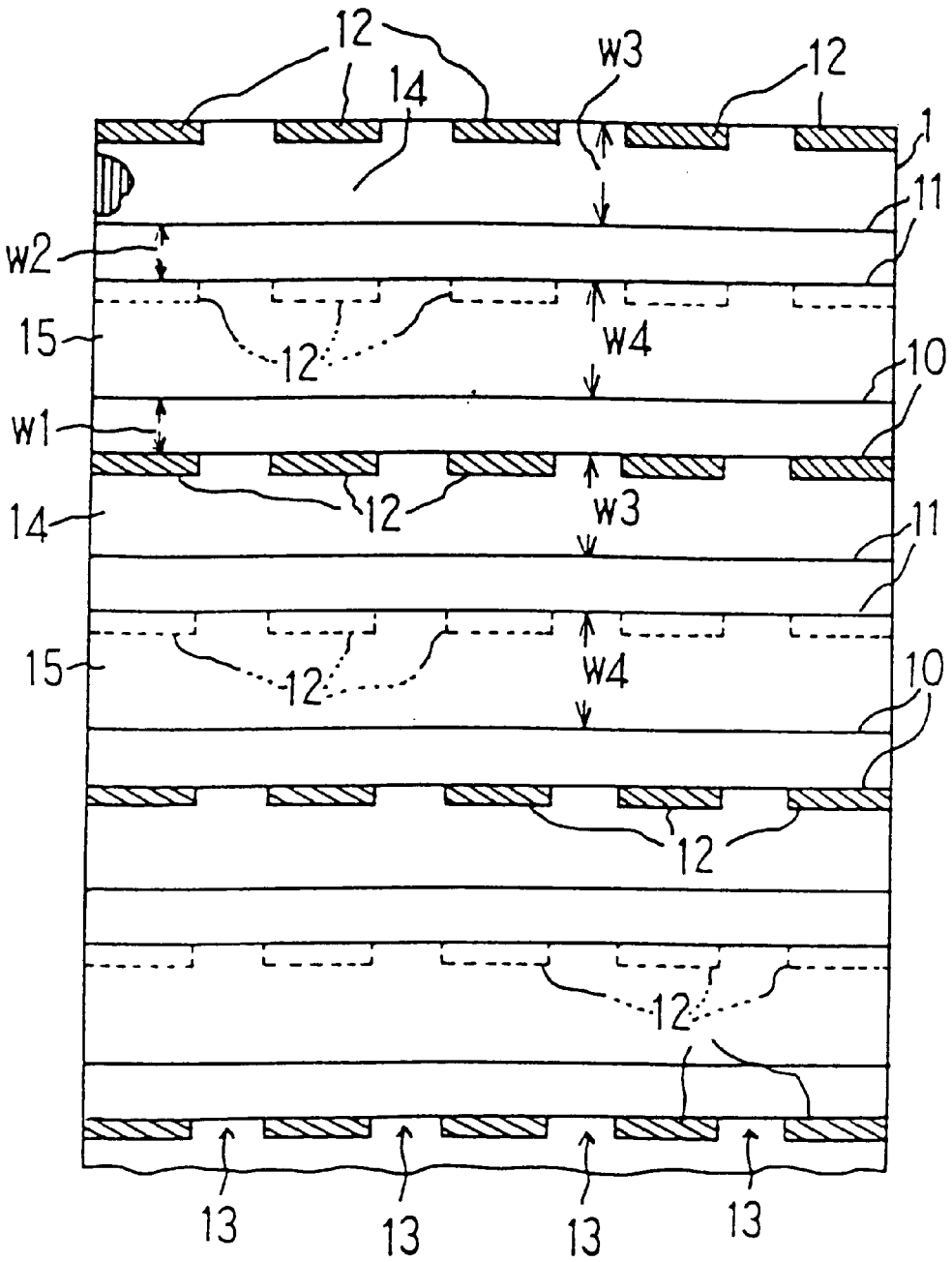
FIG. 8 is a schematic partial view of a sheet used in a method of folding and shaping a sheet according to the second embodiment.

In this working example, a sheet 1, which is a workpiece to be processed, is a corrugated cardboard. As shown in FIG. 8, it is formed with parallel ridge-like folds 10, 10 and parallel valley-like folds 11, 11 alternating in a direction which intersects the corrugations.

A directional permanency of inward folding is imparted to each of the ridge-like folds 10, whereas a directional permanency of outward folding is imparted to each of the valley-like folds 11.

Both the distance wi between the adjacent ridge-like folds 10, 10 and the distance w2 between the adjacent valley-like folds 11, 11 equal approximately 40 mm. The width w3 of a panel 14 formed between the ridge-like folds 10 and the valley-like folds 11 equals approximately 75 mm and the width w4 of another panel 15 formed therebetween equals approximately 85 mm.

The sheet 1 is formed, on a surface of the panel 14, with paste portions 12 (shown by shading) adjacent to the ridge-like folds 10, and on the opposite surface, with paste portions 12 (shown as dotted lines) adjacent to the valley-like folds 11. Non-paste portions 13 are formed along a direction which intersects the ridge-like and valley-like folds 10, 11.

Figure 9A:
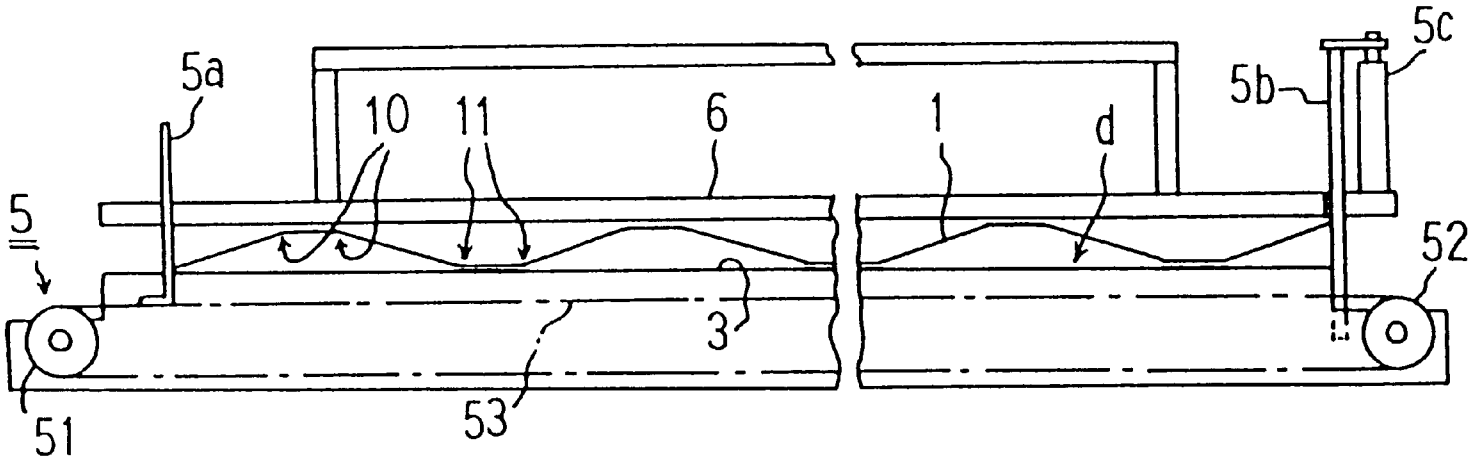
FIGS. 9(*a*) and 9(*b*) are schematic front views of the apparatus for explanation of the method for folding and shaping a sheet in accordance with the first embodiment of the present invention.
Figure 9B:
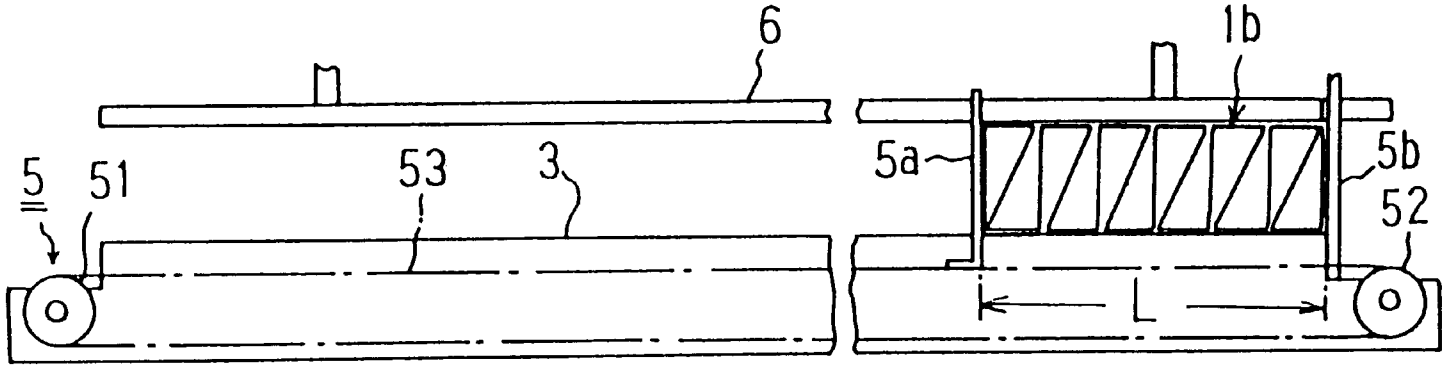

As shown in FIG. 9(*a*), after adjusting the spacing of the support and pressing guides 3 and 6, the sheet 1 is supplied onto the support guide 3 of the sheet folding and shaping apparatus.

The pusher 5*a*, stopper 5*b* and pressing guide 6 are operated in the same way as in the first working example. The pusher 5*a* applies the bending pressure to the sheet 1 while the pressing guide 6 applies pressing pressure to the same in a direction tending to increase angles of the folds 10, 11, i.e., tending to open the folds.

The sheet 1 is pressed from opposing sides so that the angles of the ridge-like and valley-like folds 10, 11 are narrowed, and finally the adjacent panels between the ridge-like and valley-like folds 10, 11 are adhered together by the paste portions 12. Thus a hollow block body 1*b* can be obtained as shown in FIG. 9(*b*). The servo motor 50 stops in the same way as the first working example, responsive to detection of a working size L of the block body 1*b* by an encoder (not shown).

According to this second working example, it is possible to manufacture the hollow block body 1*b*, having a pseudo honeycomb-like end face, smoothly and quickly according to its design.

The other features of sheet folding and shaping according to this second working example, and operations and advantages obtained thereby, are substantially the same as those of the first working example. Accordingly, the description thereof is omitted.

Third Working Example of the Sheet Folding and Sharing Method

Figure 10:
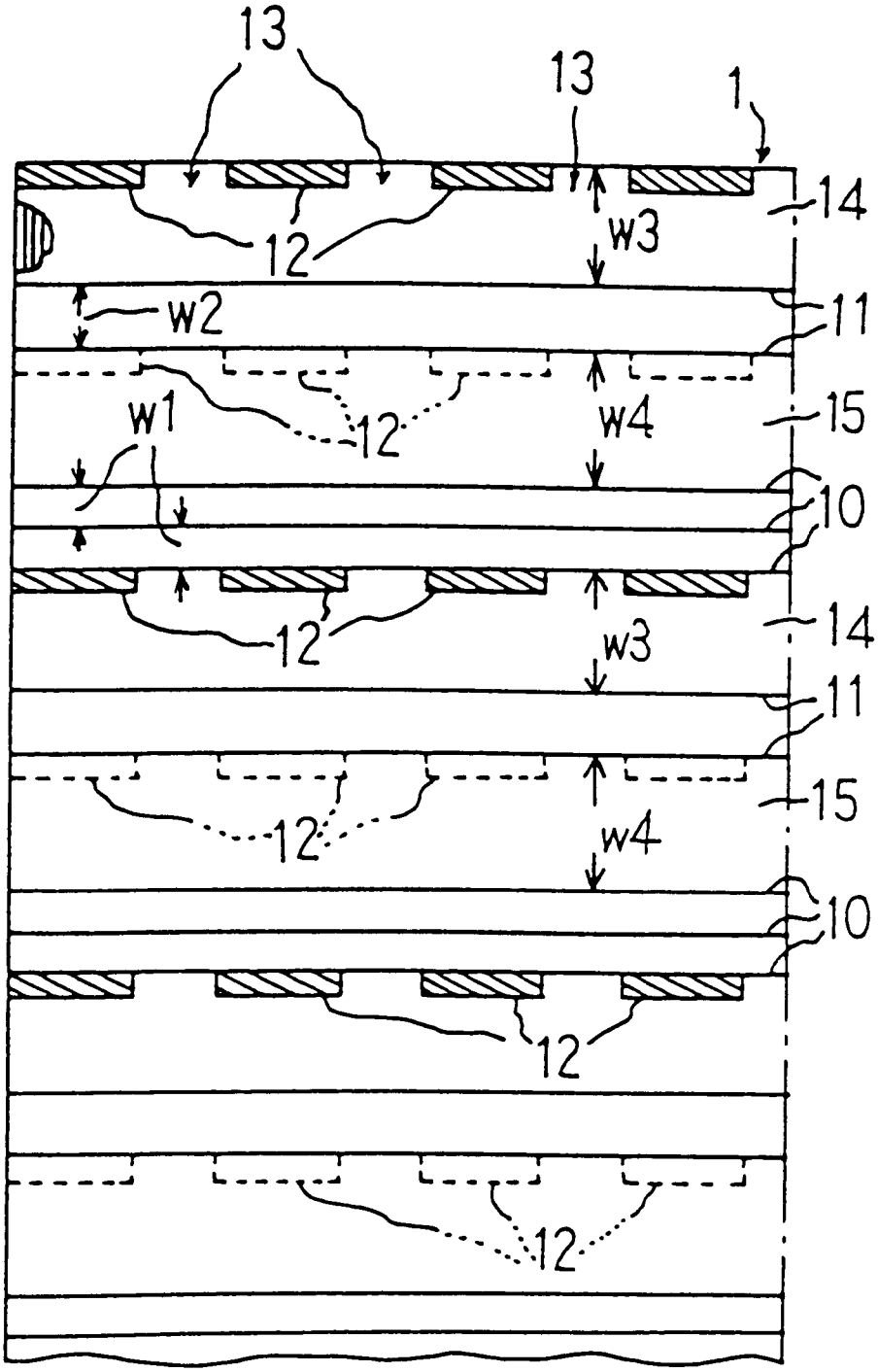
FIG. 10 is a schematic partial view of a sheet used in a method of folding and shaping a sheet according to the third embodiment.

A sheet 1 used in the third working example is a corrugated cardboard as shown in FIG. 10. It is formed with parallel valley-like folds 11, 11 and parallel ridge-like folds 10, 10, 10 positioned at equal intervals, alternately in a direction which intersects the corrugations of the core.

The distance w1 between the adjacent ridge-like folds 10, 10 equals approximately 25 mm. The width w3 of a panel 14 formed between the ridge-like folds 10 and the valley-like folds 11 equals approximately 75 mm and the width w4 of another panel 15 formed therebetween equals approximately 85 mm.

Both sides of the sheet 1 are formed with paste portions 12 and non-paste portions 13 in the substantially same positions as in the sheet 1 shown in FIG. 8.

Figure 11A:
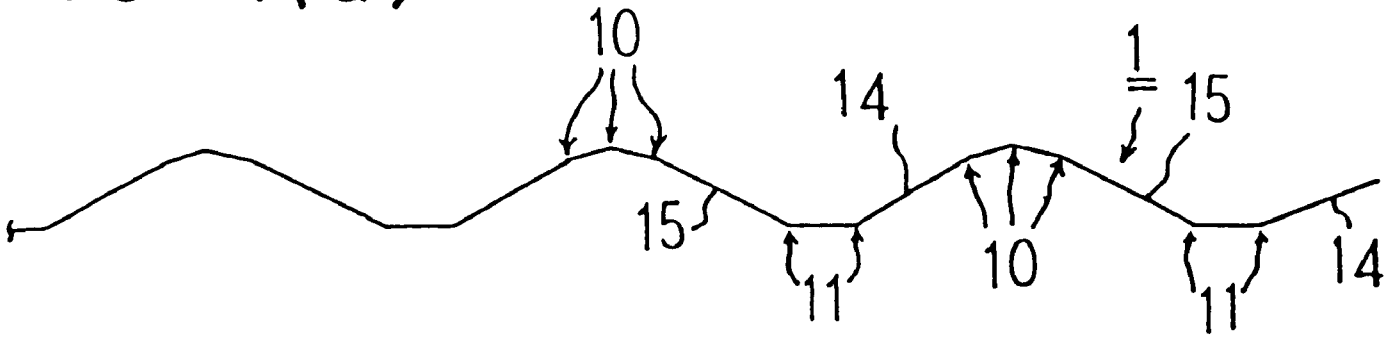
FIGS. 11(*a*) and 11(*b*) illustrate the states before and after shaping the sheet used in a method of folding and shaping a sheet according to the third embodiment.
Figure 11B:
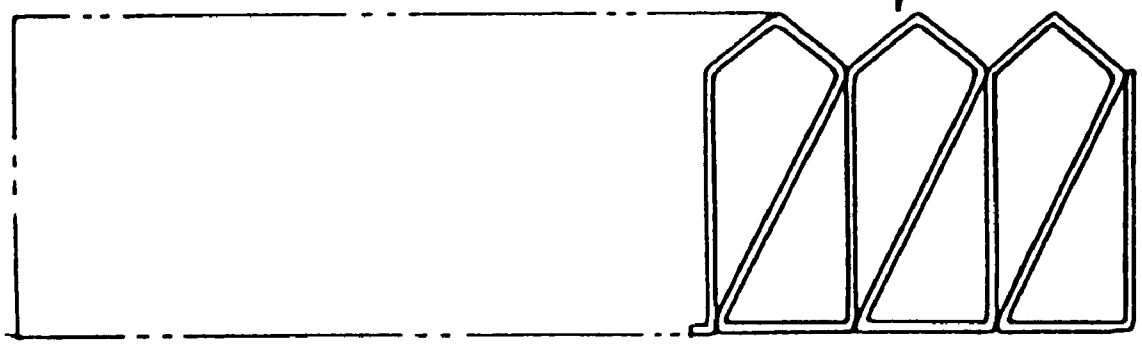

After adjusting the spacings of the support and pressing guides 3 and 6 shown in FIG. 9(*a*) in accordance with the design of the sheet 1 shown in FIG. 10, the sheet 1 in a spontaneously developed (relaxed) configuration shown in FIG. 11(*a*) is supplied onto the support guide 3.

The pusher 5*a*, stopper 5*b* and pressing guide 6 are operated in the same way as in the second working example, and the pusher Sa applies the bending pressure to the sheet 1 while the pressing guide 6 applies a light pressing pressure in a direction tending to widen the angles of the folds 10, 11. The hollow block body 1*b* having a pseudo honeycomb-like end face shown in FIG. 11(*b*) is thus manufactured.

As can be seen from this working example, in the sheet folding and shaping method according to the present invention, when the sheet 1 includes plural ridge-like folds 10 and plural valley-like folds 11, the number of the former is not necessarily same as that of the latter. In addition, the number of a set of ridge-like folds or that of valley-like folds needs not be constant.

The other features of sheet folding and shaping method according to this third working example, and operations and advantages obtained thereby are substantially the same as those of the first working example. Accordingly, the description with respect thereto is omitted.

Figure 12:
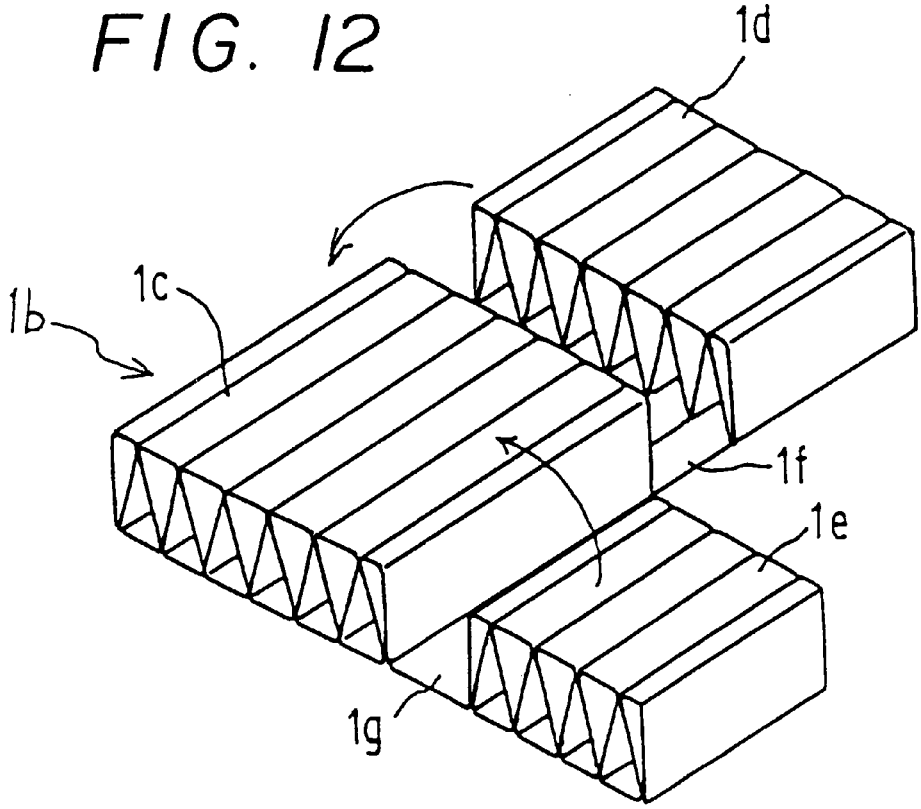
FIG. 12 is an oblique view of the block manufactured by the method of folding and shaping a sheet according to the first embodiment of the present invention.
Figure 13:
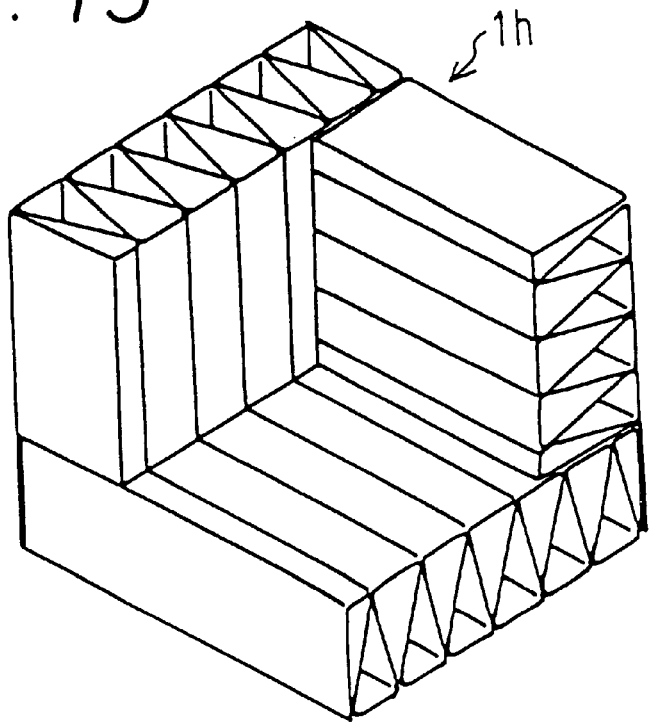
FIG. 13 is an oblique view of the block body of FIG. 12 made into a three-dimensional frame body for packaging.

Besides, it is possible to manufacture a hollow block body 1*b* from a single sheet by suitably designing the sheet 1 as shown in FIG. 12.

The block body 1*b* may include a bottom block piece ic and side block pieces 1*d* and 1*e*, which are linked with each other by sheet pieces 1*f* and 1*g* By standing the side block pieces 1*d* and 1*e* as indicated by the arrows in FIG. 12, a frame body for packaging (or cushioning member for packaging) 1*h* is thus obtained.

This frame body 1*h* is suitable for as a corner frame body for protecting a corner of goods such as a television or the like (not shown) having three-dimensional corners.

Other Embodiments

Although, in the above-described examples, the pressing guides 60 to 65 slightly press the sheet 1 from the beginning of the movement of the pusher 5*a* in the direction of folding of the sheet 1, the pressing guides 60 to 65 may start pressing the sheet 1 after the pusher 5*a* begins to move. This is because, only if the pressing guides 60 to 65 are positioned in the vicinity of the sheet 1, is it possible to prevent the portions of the sheet 1 from rising away from the support guide 3, no matter how the timing of the pressing is shifted.

Although, in the above-described embodiment, the pressing guide 6 which moves toward and away from the support surface of support guide 3 applies the pressing pressure in a direction tending to widen the angles of the ridge-like and valley-like folds 10, 11, a suitable weight member (not shown) may be substituted for the pressing guides 6 operating in the above mentioned manner and may apply the pressing pressure to the sheet 1.

Alternatively, a bar or bars (not shown) may impart a pressure to the sheet 1 using an air cylinder (not shown) of a suitable elasticity whose air pressure or the like is adjustable.

Although the apparatus of the above-described embodiment is arranged so that one of folding tools 5*a*, 5*b* can be moved, it is possible to provide the apparatus with moving drive means arranged such that both of the folding tools 5*a* and 5*b* move toward and away from the other.

Regarding to the moving drive means S, adjusting drive means 40 to 45 of the support guide 3, adjusting drive means 80 to 85 of the pressing guide 6, and drive mechanism 7 which moves the pressing guide 6 toward and away from the support surface of support guide 3, drive motors other than those disclosed in the foregoing embodiments may be used.

We claim:

1. A method of folding and shaping a sheet comprising:

supplying a sheet having a plurality of parallel fold-lines with directional folding permanency imparted at each of said fold-lines whereby the sheet assumes a corrugated configuration with alternating folds at said fold-lines defining panels therebetween in a relaxed state;

supporting the folds at one surface of said sheet in the relaxed state on a plurality of parallel spaced support bars with said folds oriented transverse to said support bars;

applying a folding pressure to opposing edges of said sheet, in a direction perpendicular to said fold-lines, to cause said opposing edges to move together to fold with said panels coming together;

applying a pressing force to the folds at the surface of said supported sheet opposite said one surface with a plurality of parallel spaced pressing bars oriented parallel to said support bars, simultaneously with application of said folding pressure; and moving one of said plurality of support bars and plurality of pressing bars away from the other as said opposing edges are moved together.

2. A method in accordance with claim 1 wherein the sheet is coated on at least one surface with spaced strips of adhesive running transverse to said fold lines and wherein the bars of one of said pluralities are arranged to contact the sheet at the spaces between said adhesive strips on said one surface.

3. A method in accordance with claim 2 wherein both of opposing surfaces of the sheet are coated with spaced strips of adhesive running transverse to said fold lines and wherein the support rods and the pressing rods are arranged to contact the sheet at the spaces between said adhesive strips.

4. A method in accordance with claim 1 wherein the sheet is a corrugated cardboard and has corrugations extending transverse to said fold-lines.

5. A method in accordance with claim 1 wherein said folding pressure is applied by plural pairs of working tools, with the working tools of each pair being respectively located at said opposing edges of said sheet, wherein at least one working tool of each of said pairs is reciprocably driven for movement relative to the other working tool of the pair.

6. An apparatus for folding and shaping a sheet comprising:

a frame;

a plurality of spaced support bars for supporting thereon folds at one surface of a sheet having a corrugated configuration with alternating ridge and valley folds at parallel fold-lines, said plurality of spaced support bars being supported by said frame and arranged transverse to said folds and parallel to each other in a first plane;

a plurality of spaced pressing bars for engaging the folds at a second surface of the sheet, opposite the one surface, and for pressing the sheet against the support bars, said pressing bars being arranged in parallel in a second plane parallel to said first plane;

at least one pair of sheet holders for engaging opposing edges of the sheet which are parallel to the fold-lines, at least one of said pair of sheet holders being mounted for linear movement parallel to said support rods, toward and away from the other of said pair of sheet holders, whereby the sheet, supported on said support bars, is folded by movement of said one sheet holder against said other sheet holder;

first drive means for reciprocably driving at least said one sheet holder toward and away from said other sheet holder; and second drive means for pressing said pressing bars against the folds of the sheet at the second surface and for moving said pressing bars away from said support bars responsive to movement of said one sheet holder toward said other sheet holder.

7. The apparatus of claim 6 wherein operation of said second drive means is coordinated with operation of said first drive means.

8. The apparatus of claim 6 comprising a plurality of said pair of sheet holders.

9. The apparatus of claim 8 wherein said other sheet holder of each of pair is fixed relative to said frame to serve as a stopper and wherein said one sheet holder of each pair is reciprocably driven by said first drive means to serve as a pusher.

10. The apparatus of claim 6 wherein each pressing bar is vertically aligned with one support bar.

11. The apparatus of claim 6 further comprising a plurality of drive mechanisms for individually moving said support bars within said first plane and for individually moving said pressing bars within said second plane.

12. The apparatus of claim 11 wherein each of said drive mechanisms for moving the pressing bars comprises:

a screw shaft mounted on said frame orthogonal to said pressing bars;

a motor for driving said screw shaft;

a screw guide fixed to one of said pressing bars, said screw guide receiving said screw shaft for movement of said one pressing bar in said second plane.

13. The apparatus of claim 11 wherein each of drive mechanisms for moving said support bars comprises:

a screw shaft mounted on said frame orthogonal to said support bars;

a motor for driving said screw shaft;

a screw guide fixed to one of said support bars, said screw guide receiving said screw shaft for movement of said one support bar in said first plane.

14. The apparatus of claim 9 further comprising an actuator for repositioning said stopper.

15. The apparatus of claim 6 wherein said first drive means comprises at least one drive mechanism for moving at least said one sheet holder, said drive mechanism comprising:

a pair of pulleys fixed to said frame at respective opposing ends of said support bars;

an endless belt or chain mounted around said pulleys with said one sheet holder fixed thereto;

a guide rail for supporting said one sheet holder along a path of its linear movement; and a motor for driving one of said pulleys.

16. The apparatus of claim 15 comprising a plurality of said drive mechanisms, each one of said drive mechanisms driving one of said sheet holders.

17. The apparatus of claim 6 wherein said second drive means comprises:

a movable frame member supporting said pressing bars;

at least one guide member supporting said movable frame for movement relative thereto in a direction perpendicular to said support bars; and a motor for reciprocably driving said moveable frame member with said relative movement.

* * * * *